United States Patent [19]

Maattanen

[11] 3,977,200

[45] Aug. 31, 1976

[54] LIGHTHOUSE OR BEACON CONSTRUCTION

[75] Inventor: Mauri Määttänen, Oulu, Finland

[73] Assignee: Oy Yleinen Insinooritoimisto, Helsinki, Finland

[22] Filed: Feb. 20, 1975

[21] Appl. No.: 551,286

[30] Foreign Application Priority Data

Feb. 25, 1974 Finland ..... 542/74

[52] U.S. Cl. ..... 61/86; 9/8 P

[51] Int. Cl.[2] ..... E02D 21/00

[58] Field of Search ..... 61/46, 46.5, 69, 52, 61/63; 9/8

[56] References Cited

UNITED STATES PATENTS

| | | | |
|---|---|---|---|
| 3,283,515 | 11/1966 | Pottorf | 61/46 |
| 3,722,223 | 3/1973 | Gratz | 61/46 |
| 3,768,268 | 10/1973 | Laffont et al. | 61/46.5 |
| 3,793,843 | 2/1974 | Malkiel | 61/46 |

*Primary Examiner*—Jacob Shapiro

*Attorney, Agent, or Firm*—Friedman & Goodman

[57] ABSTRACT

The invention relate to a lighthouse or beacon construction characterized in that in order to isolate vibrations, the upper part of the construction is not in rigid connection with the lower part subject to forces which cause vibrations, but the construction is broken at a suitable height and the upper part is mounted on the lower part so that it is supported by slide rails, roll rails, wheels, a flexible or pivoted parallelogram mechanism or elastic poles, or a corresponding flexible mechanism, so that the lower part can move substantially horizontally in relation to the upper part while the upper part is maintained in substantially vertical position.

14 Claims, 8 Drawing Figures

LIGHTHOUSE OR BEACON CONSTRUCTION

Figure 1:
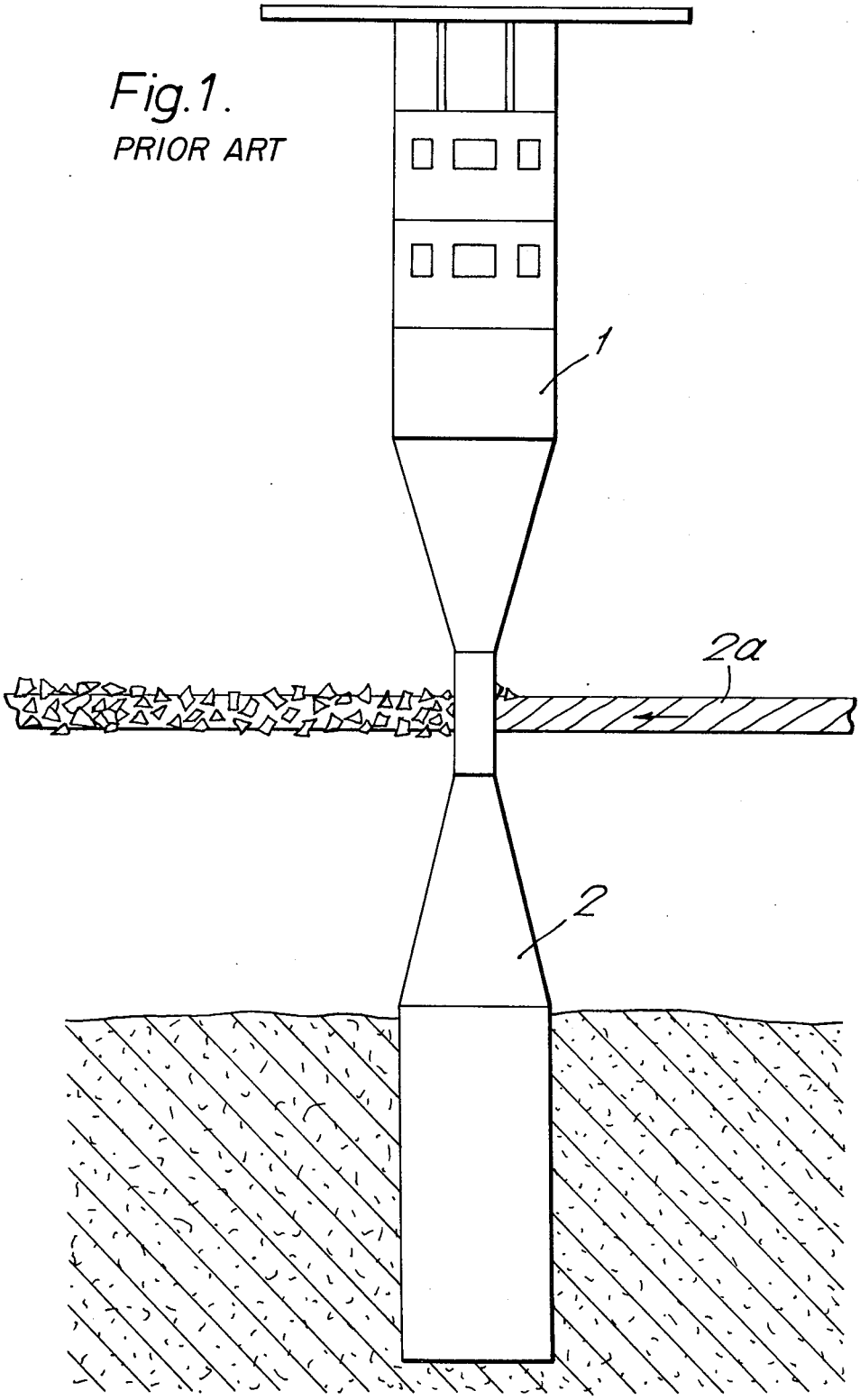
Fig. 1. PRIOR ART

This invention relates to a lighthouse or beacon construction fastened to the sea bottom, or corresponding pillar construction. The object of the invention is to repress vibrations caused by the ice forces. Constructions of this kind are, for instance, lighthouses or beacons, edge signs and line boards along channels of fairways. Moving ice cause harmful trembles and vibrations of these structures.

Lighthouse or beacon structures subject to forces caused by ice have usually been made of steel concrete so massive that vibrations caused by ice would not be harmful. However, constructions like this become costly because of the difficult preparing of the submarine basement which has to be done at sea. A lighthouse or beacon with a steel structure manufactured at workshop and assembled of parts has been suggested and put into practice as an economical construction. The operation to be carried out at sea is short, the parts manufactured at workshop are driven to the site, basement is driven into the bottom, and the parts above water surface are bolted or welded onto the basement. One further advantage of a steel lighthouse or beacon is that it requires less maintenance than a steel concrete lighthouse or beacon.

Heavy vibrations at the upper parts, caused by ice are a disadvantage of a steel structure lighthouse or beacon. Vibrations are so violent that they break conventional light sources of lighthouses or beacons, and moving ice make it both upleasant and dangerous for people to stay in the lighthouse. For instance, horizontal accelerations of 3.6 g ($g$ = acceleration of gravity) and amplitudes of 20 cm have been measured in practice. Vibrations could be decreased by building the lower part very rigid and massive, but then the advantage of manufacturing a basemenr is lost.

A construction according to this invention is characterized in that in order to isolate vibrations, the upper part of the construction is not in rigid connection with the lower part subject to forces which cause vibrations, but the construction is broken at a suitable height and the upper part is mounted on the lower part so that it is supported by slide rails, roll rails, wheels, a flexible or pivoted parallelogram mechanism or elastic poles, or a corresponding flexible mechanism, so that the lower part can move substantially horizontally in relation to the upper part while the upper part is maintained in substantially vertical position.

In this way, movement is not transferred to the upper part when ice is shaking the lower part. The upper part can be centered in relation to the lower part by means of one or several springs, in connection with which shock absorbers can be provided. Typical to the breaking down of a lighthouse or beacon according to the invention is also that the upper part is maintained as vertical as possible so that the direction of the light source remains unchanged while the lower part vibrates. It is also easy to provide a restricter of the horizontal movement in connection with the break-down. For instance, when a high pack-ice wall deviates the upper part against the restricter, the connection between the upper part and the lower part becomes rigid, and the lighthouse or beacon acts as a single pillar in this case. When the pressure by pack-ice is released, the spring centers the upper part so that the lower part can again vibrate independently of the upper part.

During a high pack-ice wall, substantial vibrations do not occur, only ice pressure appears, as the high ice wall extends down to the bottom and moves slowly.

By calculations it can be proved that by means of a construction according to this invention it is possible to significantly repress the vibrations of the upper part of a steel structure lighthouse or beacon. For instance, by dimensioning the centering spring in such a way that the specific frequency of the horizontal vibrations of the upper part is one quarter of the lowest specific frequency of the lower part, the vibration amplitude of the upper part is reduced into about 1/15 of the original vibration of the power part. In this way, the load on the light sources is no more critical, and the lighthouse is safe for the crew, irrespective of movements of ice.

Figure 2:
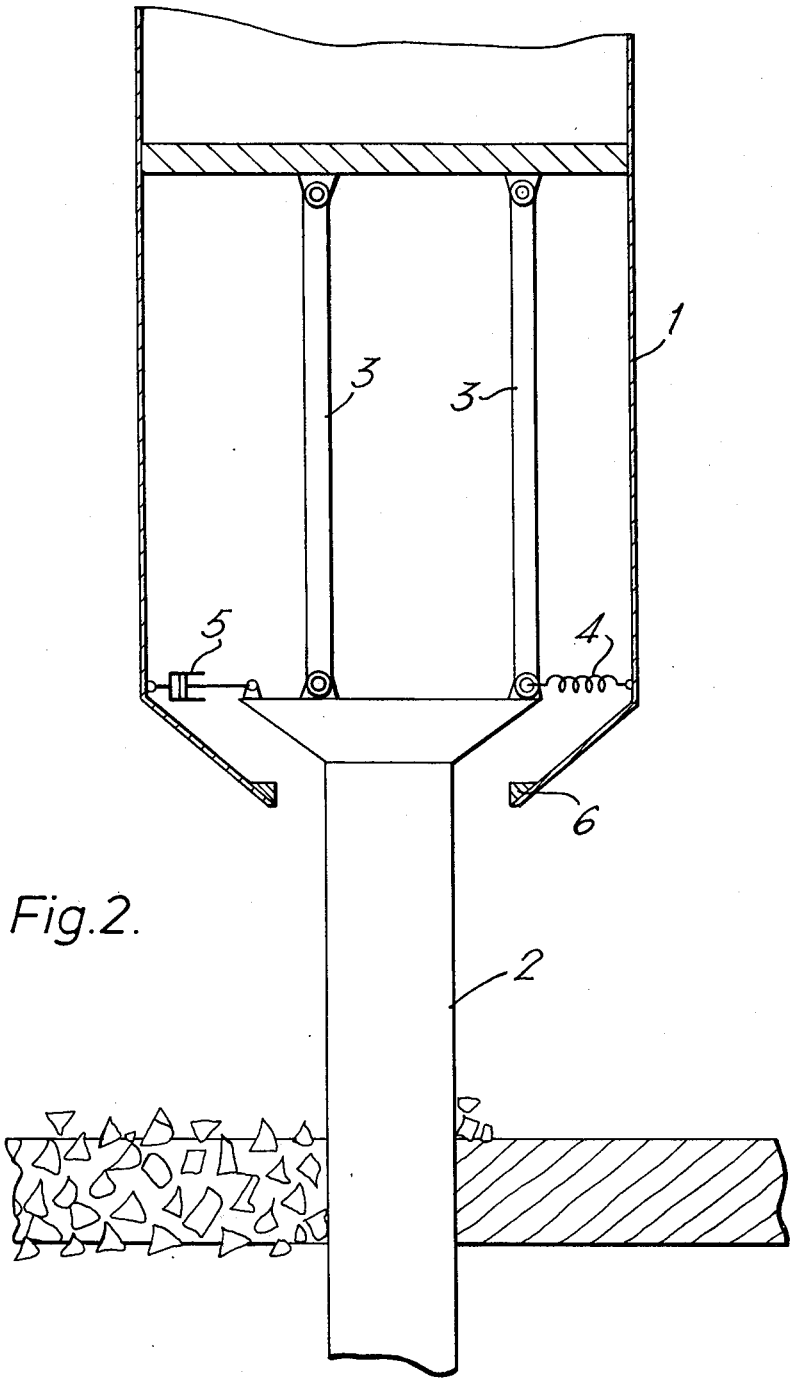
Figure 3:
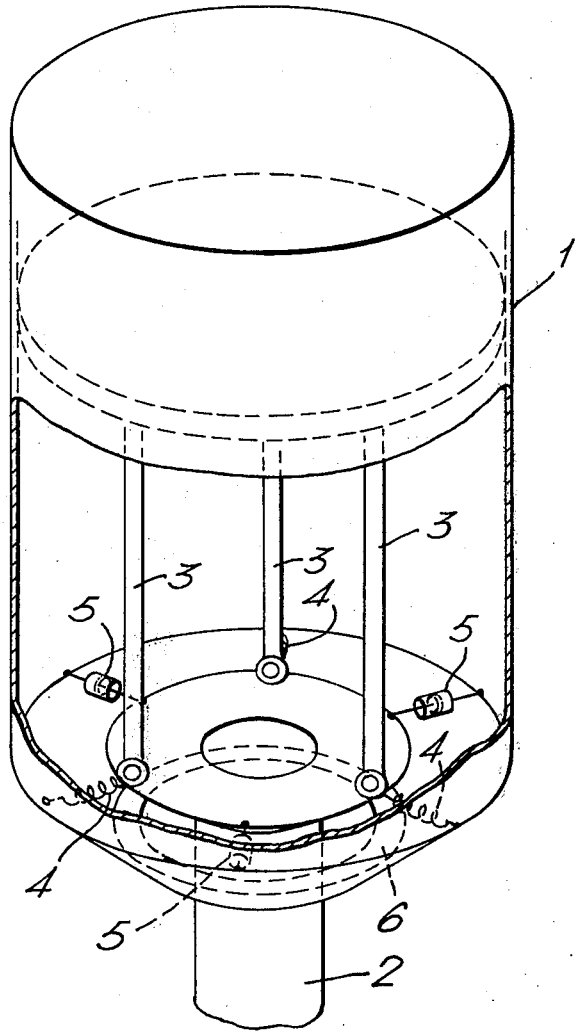
Figure 4:
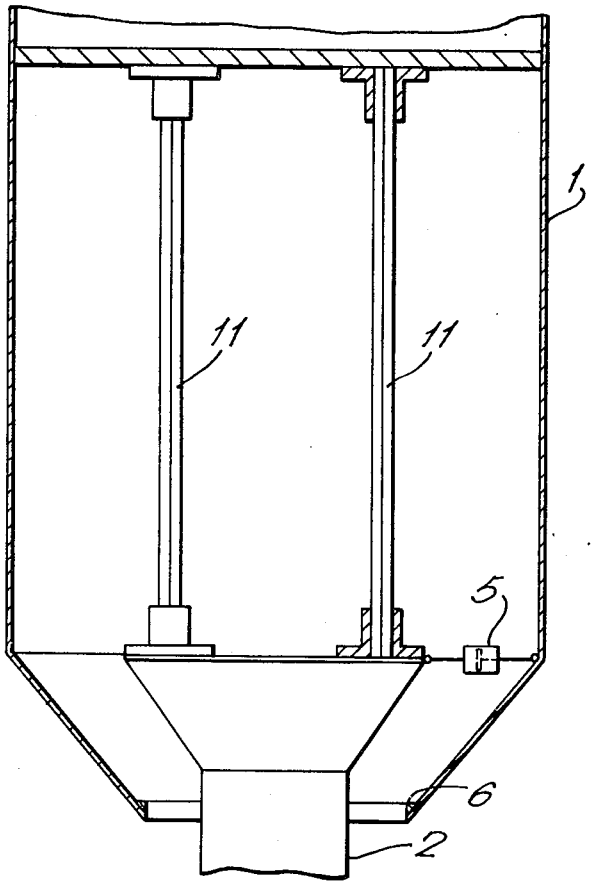
Figure 5:
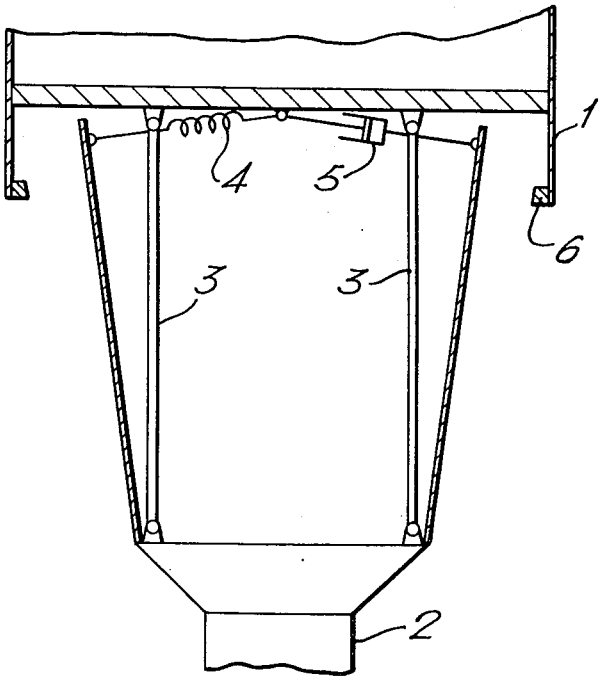
Figure 6:
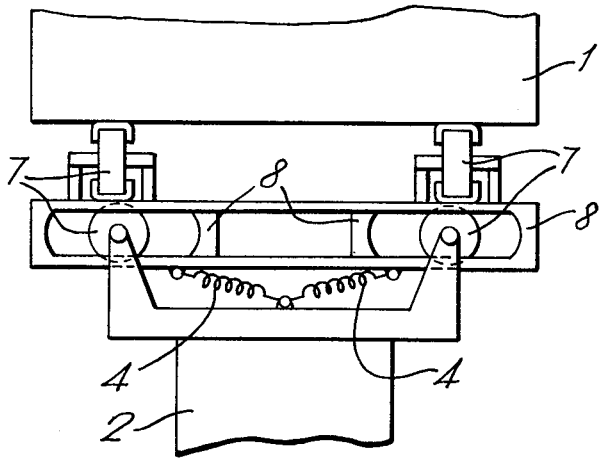
Figure 7:
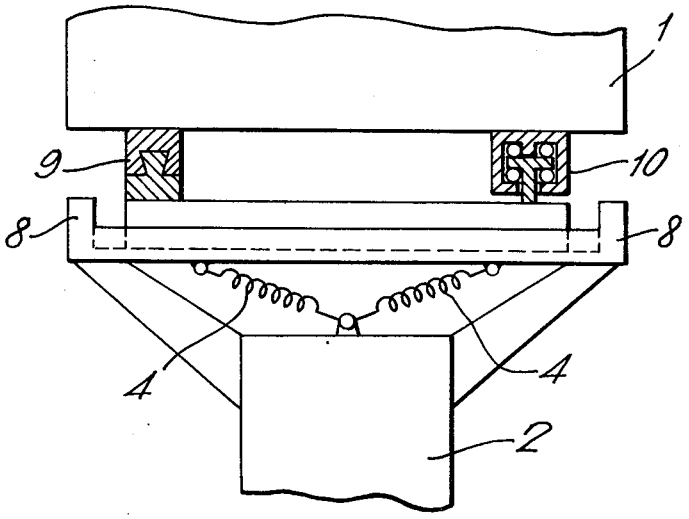
Figure 8:
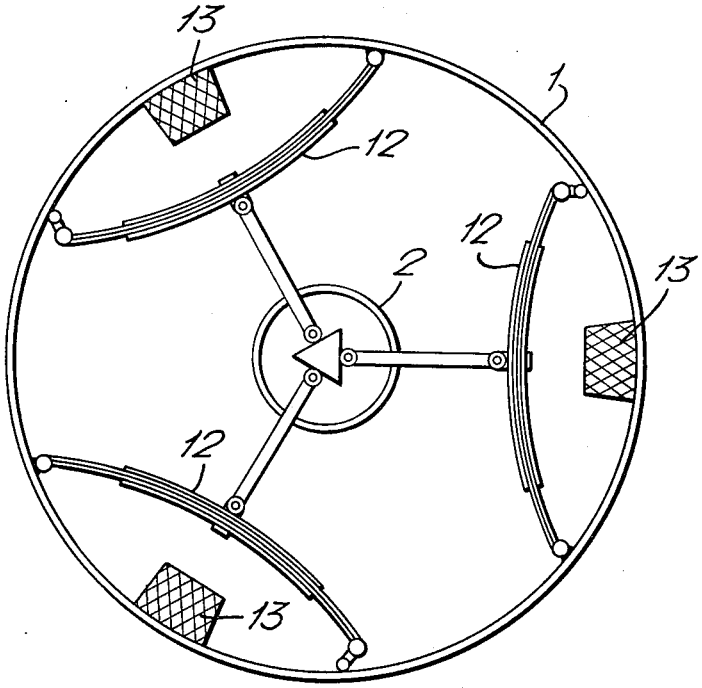

The invention is described in detail in the following with reference to the accompanying drawings in which:

FIG. 1 shows a conventional steel structure lighthouse, without a construction for isolating vibrations, FIG. 2 shows the principle for isolating vibrations, applied by means of pivoting or flexible poles, FIG. 3 shows one embodiment of the principle of FIG. 2, FIG. 4 shows an embodiment of the invention, applied by means of elastic poles, FIG. 5 shows the principle of FIG. 2, applied in the opposite way, FIG. 6 shows an embodiment of the invention, using wheels, FIG. 7 shows an embodiment using slide or roll rails, and FIG. 8 shows an embodiment where leaf springs are used.

FIG. 1 shows a steel structure lighthouse, without a construction for isolating vibrations according to the invention. Light sources and possible crew rooms are located in the upper part 1. The lower part 2 is driven into the bottom, the connection with the upper part is rigid, and the frame tube is tapered at the water line in order to reduce forces caused by ice 2*a*.

FIG. 2 shows an embodiment of the invention in principle, applied to a steel structure lighthouse or beacon. The upper part 1 rests on the lower part 2 supported by a pivoting or flexible parallelogram 3. The centering of the upper part in relation to the lower part is provided by a spring 4, and if necessary, a shock absorber 5 can be provided in connection with the spring. The spring in connection with the pivoting parallelogram mechanism must be sufficiently stiff to maintain static stability when the center of gravity of the upper part is located above the supporting point of the joint. The horizontal movement of the upper part is restricted by a ring 6 as this is pressed against the frame tube of the lower part. The parallelogram mechanism keeps the upper part in vertical position, and if desired, in order to eliminate the effect of the inclination of the lower part as this is bent by vibrations, the parallelogram can be made slightly trapezoid by reducing the distance between the pivoting points in the upper part.

FIG. 3 shows a practical embodiment of a pivoting parallelogram mechanism which allows simmutaneous movement in all horizontal directions. The figure shows the minimum number of parallelogram poles, that is three poles, but the number can be even higher. The same elements from 1 to 6 as in FIG. 2, can be seen also in FIG. 3. Of course it is possible to apply and position a parallelogram mechanism, springs and shock absorbers in ways other than have been illustrated in FIGS. 2 and 3.

FIG. 4 shows a way of breaking down a lighthouse or beacon so that the upper part 1 is supported by the lower part 2 by means of elastic poles 11. When the upper part moves in relation to the lower part, the poles are bent similar in form so that the upper part is maintained in vertical position. At the same time, the poles 11 act as springs and center the upper and lower parts in relation to each other. Shocks are absorbed by a absorber 5, and the horizontal movement is restricted by a ring 6.

FIG. 5 shows the same principle as FIG. 2 except that the spring 4 and the shock absober 5 and the restricting ring 6 are placed in connection with the upper ends of the pivoted poles 3. The principle of FIG. 4 can of course also be applied using the corresponding placements.

FIG. 6 shows a way of breaking down a lighthouse or beacon so that the horizontal movement of the upper and lower parts in relation to each other is provided by means of wheels 7 moving on rails at right angles to each other. The movement is centered by a spring 4. Also a shock absorber and stoppers 8, to restrict the movement, can be provided.

FIG. 7 shows an embodiment where the wheels of FIG. 6, moving on rails, are replaced by a grooved sliderail 9, or by a roll or ball rail 10. Both the wheel rails of FIG. 6 and the grooved or roll rails of FIG. 7 can be made suitably curved in order to eliminate inclinations of the lower part 2 of the light house construction from the movement of the upper part 1.

FIG. 8 shows an embodiment where the centering spring 4 is replaced by leaf springs 12. In this way the good absorbing properties of leaf springs give a further advantage so that a shock absorber 5 is not necessary. The horizontal movement is restricted by means of rubber cushions 13.

The breaking down principle according to the invention can be applied also to other pillar constructions where a certain section is to be isolated from vibrations.

I claim as my invention:

1. A lighthouse or beacon construction comprising an upper part adapted to house light sources, crew rooms and the like, a lower part adapted to be driven into a sea bottom to fasten said construction to the sea bottom, said lower part including a single rigid frame member extending upwardly above the water line to support said upper part, connection members for connecting said upper part to said single member of said lower part in a non-rigid connection to permit said lower part to move substantially horizontally in relation to said upper part, said connecting means maintaining said upper part in a substantially vertical position when said lower part moves horizontally, said connecting means including spring means for centering said upper part in relation to said single member of said lower part, and restriction means coacting between said upper and lower parts for restricting horizontal movement of said upper part.

2. A construction as claimed in claim 1, wherein said connecting means includes a plurality of vertically disposed poles having their upper ends connected to said upper part and their lower ends connected to said single member of said lower part, said poles being elastic to define said spring means to permit said poles to bend for maintaining said upper part in said vertical position and for centering said upper part in relation to said single member of said lower part.

3. A construction as claimed in claim 2, wherein said restriction means includes a ring connected to a lower portion of said upper part, said ring being disposed around said single member of said lower part in a spaced-apart relationship, whereby said ring abuts against said single member to restrict horizontal movement of said upper part.

4. A construction as claimed in claim 2, wherein shock absorber means are connected between said upper part and said single member of said lower part to absorb shocks of said upper part.

5. A construction as claimed in claim 1, wherein said restriction means includes a ring connected to a lower portion of said upper part, said ring being disposed around said single member of said lower part in a spaced-apart relationship, whereby said ring abuts against said single member to restrict horizontal movement of said upper part.

6. A construction as claimed in claim 5, wherein shock absorber means are connected between said upper part and said single member of said lower part to absorb shocks of said upper part.

7. A construction as claimed in claim 1, wherein shock absorber means are connected between said upper part and said single member of said lower part to absorb shocks of said upper part.

8. A construction as claimed in claim 1, wherein said connection means includes a plurality of vertically disposed poles having their upper ends pivotly connected to said upper part and their lower ends pivotly connected to said single member of said lower part to define a flexible pivoting parallelogram mechanism.

9. A construction as claimed in claim 8, wherein said spring means are disposed adjacent to said lower ends of said poles.

10. A construction as claimed in claim 8, wherein said spring means are disposed adjacent to said upper ends of said poles.

11. A construction as claimed in claim 1, wherein said connection means includes at least one of wheels moving on rails, grooved side rails and rool rails which are disposed between said upper part and said single member of said lower part.

12. A construction as claimed in claim 11, wherein said restriction means includes end stoppers coacting with said rails to define shock absorbers to absorb shocks of said upper part.

13. A construction as claimed in claim 1, wherein said spring means includes leaf springs horizontally disposed between said upper part and said single member of said lower part to define shock absorbers to absorb shocks of said upper part.

14. A construction as claimed in claim 13, wherein said restriction means includes rubber cushions and the like disposed on an inner surface of said upper part.

* * * * *